US007207385B2

(12) United States Patent
Smith et al.

(10) Patent No.: US 7,207,385 B2
(45) Date of Patent: Apr. 24, 2007

(54) METHOD AND SYSTEM FOR PRODUCING GAS AND LIQUID IN A SUBTERRANEAN WELL

(75) Inventors: Thomas B. Smith, Centennial, CO (US); Yale M. Preston, Story, WY (US)

(73) Assignee: Marathon Oil Company, Houston, TX (US)

( * ) Notice: Subject to any disclaimer, the term of this patent is extended or adjusted under 35 U.S.C. 154(b) by 190 days.

(21) Appl. No.: 10/867,528

(22) Filed: Jun. 14, 2004
(Under 37 CFR 1.47)

(65) Prior Publication Data

US 2005/0274515 A1 Dec. 15, 2005

(51) Int. Cl.
*E21B 43/38* (2006.01)
*E21B 21/06* (2006.01)

(52) U.S. Cl. ..... 166/265; 166/369; 166/75.12

(58) Field of Classification Search ..... 166/265, 166/370

See application file for complete search history.

(56) References Cited

U.S. PATENT DOCUMENTS 4,074,763 A * 2/1978 Stevens ..... 166/325
4,687,060 A 8/1987 Richards et al.
5,482,117 A * 1/1996 Kolpak et al. ..... 166/265
6,155,751 A 12/2000 Lane et al.
6,361,272 B1 3/2002 Bassett
6,367,555 B1 4/2002 Senyard, Sr. et al.
6,382,321 B1 5/2002 Bates et al.
6,604,580 B2 8/2003 Zupanick et al.
6,845,821 B2 * 1/2005 Bouma et al. ..... 166/369
6,959,764 B2 * 11/2005 Preston ..... 166/265

* cited by examiner

*Primary Examiner*—Frank Tsay
(74) *Attorney, Agent, or Firm*—Jack E. Ebel

(57) ABSTRACT

A method for producing a gas and a liquid in a subterranean well includes the step directing a gas flow in a well annulus through one or more baffle plates to separate at least some of the liquid from the gas. The method can also include the steps of directing the separated liquid down the annulus towards a producing formation of the well, dehydrating the gas flow proximate to a surface of the well, and then directing the dehydrated gas flow to the surface. A system for performing the method includes a set of baffle plates located proximate to the producing formation configured to provide a tortuous path for the gas flow through the annulus, and a single baffle plate located proximate to the surface configured to dehydrate the gas flow. In addition to separating the liquid from the gas flow, the set of baffle plates maintains a single phase wet gas above the baffle plates, and a liquid phase below the baffle plates.

66 Claims, 14 Drawing Sheets

GAS AND LIQUID FLOW

LIQUID FLOW

GAS FLOW

GAS AND LIQUID FLOW

LIQUID FLOW

METHOD AND SYSTEM FOR PRODUCING GAS AND LIQUID IN A SUBTERRANEAN WELL

FIELD OF THE INVENTION

This invention relates generally to subterranean wells, and more particularly to a method and system for producing gas and liquid in a subterranean well.

BACKGROUND OF THE INVENTION

Subterranean wells are used to produce various gases and liquids. For example, a subterranean well can be used to produce methane gas and liquid water from a coal seam. This type of subterranean well can include a well bore from the surface to the coal seam, a well casing cemented to the well bore, and a metal tubular within the well casing. The well can also include a submerged pump located within an under reamed cavity in the coal seam. During production from the well, water is pumped from the cavity, and through the tubular, to water production equipment at the surface. In addition, gas flows from the coal seam into the cavity, and through the annulus between the tubular and the well casing, to gas production equipment at the surface.

The methane gas can cause various problems with the submerged pump during production from the well. For example, the pump can experience vapor lock due to excessive gas flow through the pump. This vapor lock can create inefficient pump operation, and excessive duty time for the pump motor. In addition, motor cycling and gas moving through the pump can cause excessive motor heating, and premature failure of the pump and/or motor. Production of gas through the tubular is also a problem, as this gas is entrained with the water, rather than being produced to the gas production equipment at the surface.

One prior art approach to gas flow through the pump is the use of gas shrouds on the pump, which prevent gas from entering the pump inlet. U.S. Pat. No. 6,361,272 B1 to Bassett entitled "Centrifugal Submersible Pump", discloses a submersible pump having this type of gas shroud. However, gas shrouds are not always effective in coal bed methane wells, or other pumping installations, which require the pump to be landed within the cavity in the coal seam, or above a producing zone of the well. In addition, gas can be driven downward and into the pump in a u-tubing manner, as heads of water fall back down the annulus, after they can no longer be lifted toward the surface by gas flowing up the annulus.

The liquid water can also cause various problems during production from the well. For example, water and/or wet gas flowing in the annulus of the well can enter the gas production equipment at the surface. This water can cause excess flowline pressures, lines filling with water, and metering errors in the gas production equipment. Water in the annulus, and water heads moving up and down the annulus, can also create harmful fluid column effects, such as unsteady production of water and/or gas from the well, due to the relative position and amount of fluid movement in the annulus.

One prior art approach to water accumulation in the gas production equipment is the use of drips and blowdown lines in low-lying areas of the gas production equipment, such as surface gas lines. These drips must be vented regularly to blow out the accumulated water. Typically, due to the low pressures in coal bed methane gas lines (e.g., less than 20 psig), the blowing of drips is manpower intensive, and inefficient in comparison to lines operating at higher pressures. It would be advantageous to eliminate water entirely from gas production equipment at the surface, and the need to blow drips from this equipment.

The present invention is directed to a novel method and system for producing gas and liquid in a subterranean well, in which gas flow through a submersible pump, and liquid flow through a well annulus to the surface, are substantially eliminated. In addition, the method and system can be adapted to different types of wells, including wells that employ formation pressures rather than pumps, to move the gas and the liquid.

SUMMARY OF THE INVENTION

In accordance with the present invention, a method and a system for producing a gas and a liquid in a subterranean well having an annulus are provided. The method, broadly stated, comprises directing the gas and the liquid in the annulus through at least one baffle plate in the annulus to separate at least some of the liquid from the gas. The separated liquid is directed downward towards a producing formation of the well, while the gas continues upward towards a surface of the well. The method can be performed in wells having a downhole pump for producing the liquid to the surface, and in wells that use formation pressures to produce the liquid to the surface.

In a first embodiment the system includes a set of baffle plates mounted in the well annulus proximate to a pump of the well, and a single baffle plate mounted in the well annulus proximate to the surface of the well. The set of baffle plates can comprise annular plates threadably attached to a metal tubular of the well, and having one or more through openings in a selected geometry and pattern. The set of baffle plates are configured to create a tortuous flow path through which any gas flow (or liquid flow) moving in either direction in the well annulus must pass. In addition to separating the liquid from the gas, the set of baffle plates maintains a wet gas phase above the set of baffle plates, and a liquid phase below the set of baffle plates. The single baffle plate is configured to further dehydrate the gas flowing to the gas production equipment at the surface.

The system prevents vapor lock in the pump, eliminates the need for a gas shroud on the pump, and improves the efficiency of the pump. The system also prevents liquid from surfacing and collecting in liquid production equipment, and reduces overall system back pressures caused by liquid low spots in the liquid production equipment. In addition, the system improves gas flow in the annulus, reduces gas loss through production with the liquid, and reduces effective formation backpressures caused by a higher density fluid in the annulus above the producing formation.

A second embodiment system includes a single baffle plate in the well annulus located proximate to the surface of the well. A third embodiment system includes a set of baffle plates in the well annulus located proximate to the pump of the well. A fourth embodiment system includes a set of baffle plates located proximate to an inlet of a tubular configured to produce gas and liquid by formation pressure. A fifth embodiment system includes a set of baffle plates located proximate to a perforated casing and a perforated tubular configured to produce gas and liquid by formation pressure. A sixth embodiment system includes a set of baffle plates located proximate to an inlet of a tubular located above a perforated section of casing configured to produce gas and liquid by formation pressure.

DETAILED DESCRIPTION OF THE PREFERRED EMBODIMENTS

Figure 1:
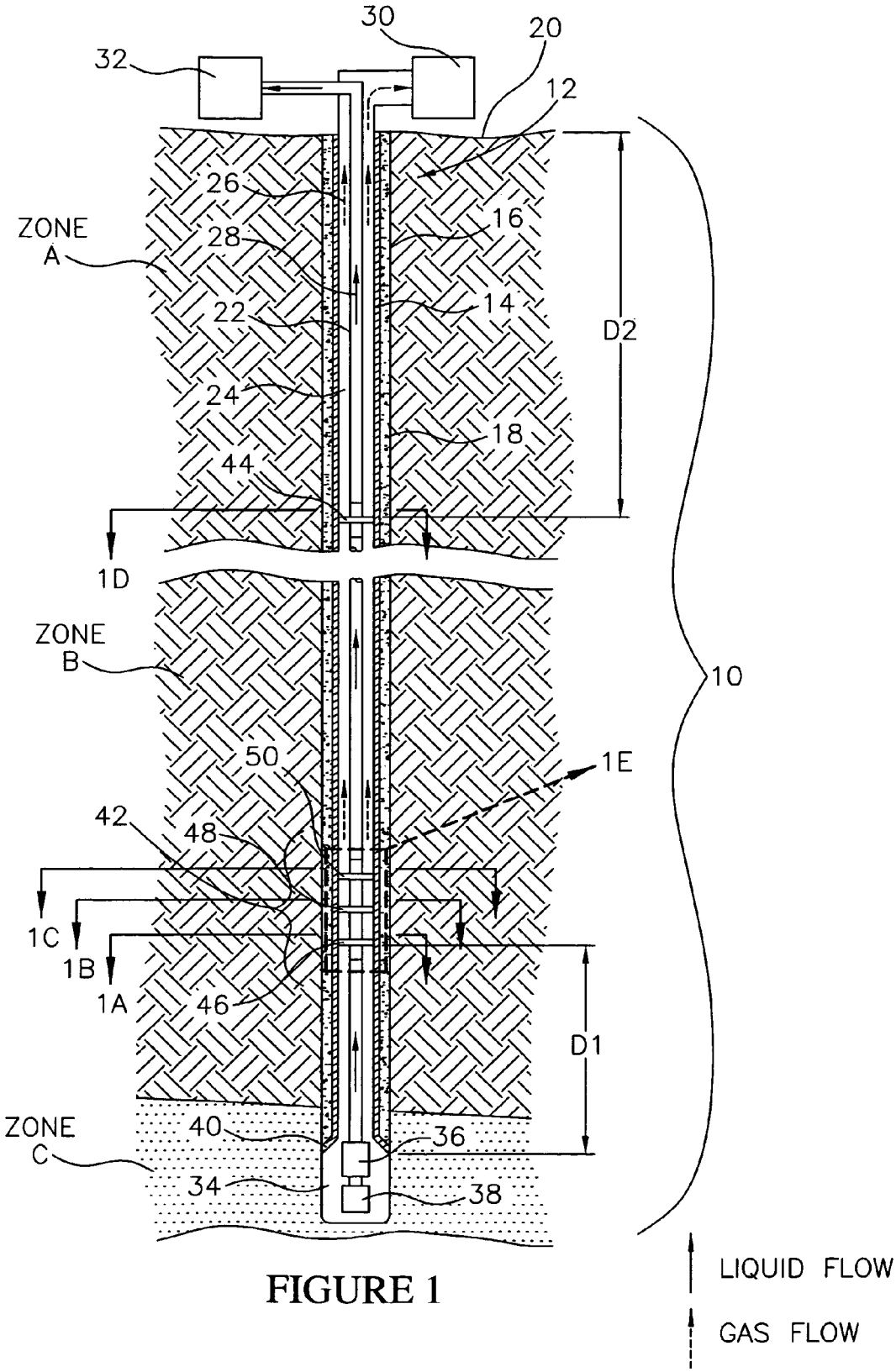
FIG. 1 is a schematic cross sectional view of a gas well having a system for producing gas and liquid in accordance with the invention.

Referring to FIG. 1, a system 10 (first embodiment) and a well 12 for producing a gas and a liquid in accordance with the invention are illustrated. In the system 10, the well 12 comprises a coal bed methane well, the gas comprises methane, and the liquid comprises water. However, as will be further explained, the system 10 can be adapted to different types of wells and downhole configurations including wells pumped with a surface mounted beam pump jack, sucker rods, and a downhole rod activated pump.

The well 12 includes a well bore 16, and a well casing 14 within the well bore 16 surrounded by concrete 18. The well 12 extends from an earthen surface 20 through geological formations within the earth, which are represented as Zones A, B and C, with Zone C comprising a producing formation, such as a coal seam. The well casing 14 can comprise a plurality of cylindrical metal tubulars, such as lengths of metal pipe or tubing, attached to one another by collars (not shown), or weldments (not shown), configured to form a conduit for gas transmission therethrough.

The well 12 also includes a tubular 22 within the well casing 14, which can also comprise a plurality of cylindrical metal tubulars configured to form a conduit for liquid transmission through the inside diameter thereof. The tubular 22 has an outside diameter which is less than an inside diameter of the well casing 14, such that an annulus 24 is formed between the tubular 22 and the well casing 14 for the gas transmission. The annulus 24 is in flow communication with gas production equipment 30 at the surface 20. Similarly, the inside diameter of the tubular 22 is in flow communication with liquid production equipment 32 at the surface 20.

The well 12 also includes a cavity 34 in the producing formation (Zone C). The cavity 34 can comprise an uncased portion of the well bore 16 or a cased portion having flow openings in the well casing 14. The cavity 34 can also comprise an under reamed cavity having a size larger than the well bore 16 formed using techniques that are known in the art. In the illustrative embodiment, the well casing 14 includes a casing shoe 40 within the cavity 34 configured to direct gas flow from the cavity 34 into the annulus 24. Also in the illustrative embodiment, the gas comprises methane gas, which flows under a natural or externally generated pressure from the producing formation (Zone C) into the cavity 34. The paths of a gas flow 26 in the well 12 will be more fully described as the description proceeds.

The well 12 also includes a submersible pump 36 in the cavity 34 powered by an electric motor 38. The inlet of the pump 36 is in flow communication with any standing liquid accumulating within the cavity 34. In the illustrative embodiment, the liquid comprises water, which flows under a natural or externally generated pressure from producing formation (Zone C) into the cavity 34. The outlet of the pump 36 is in flow communication with the inside diameter of the tubular 22, and with the liquid production equipment 32. The pump 36 thus pumps the liquid from the cavity 34 through the inside diameter of the tubular 22 to the liquid production equipment 32. However, some of the liquid also flows into the annulus 24 in both an upward and a downward direction. The paths of a liquid flow 28 in the well 12 will be more fully described as the description proceeds.

The system 10 includes a set of baffle plates 42 attached to the tubular 22, and located at a selected depth in the well 12. Preferably the set of baffle plates 42 is located proximate to the producing formation (Zone C), the cavity 34, the pump 36 and the casing shoe 40. The set of baffle plates 42 includes a first baffle plate 46, a second baffle plate 48 and a third baffle plate 50. The baffle plates 46, 48, 50 are arranged in a stacked array with the first baffle plate 46 being furthest from the surface 20, the second baffle plate 48 being between the first baffle plate 46 and the third baffle plate 50, and the third baffle plate 50 being closest to the surface 20.

In the illustrative embodiment, the set of baffle plates 42 is located in close proximity to the cavity 34, the casing shoe 40 and the pump 36. By way of example, a distance D1 between the set of baffle plates 42 and the edge of the casing shoe 40 (with the casing shoe 40 and the pump 36 being located in the cavity 34 in close proximity to one another) can be from about one foot to thirty feet. The first baffle plate 46, the second baffle plate 48 and the third baffle plate 50 can also be separated from one another by a selected distance, with from one foot to three feet of separation between adjacent baffle plates 46, 48 or 50 being representative. However, it is to be understood that the number, placement and separation of the baffle plate 46, 48 and 50 are merely exemplary, and other arrangements with a fewer or greater number of baffle plates can be employed.

The set of baffle plates 42 is configured to create a tortuous path for the gas flow 26 and the liquid flow 28 moving mainly in an upward direction, but also in a downward direction in the annulus 24. In addition, the set of baffle plates 42 is configured to separate the liquid from the gas, and to maintain a line of separation in the annulus 24, above which a single phase wet gas is present, and below which a head of liquid is present. Further, gas flow into the pump 36 is substantially reduced because the set of baffle plates 42 maintains the head of liquid proximate to the pump 36. Still further, the set of baffle plates 42 prevents liquid columns from developing in the annulus 24 due to liquid entrained in the gas stream rising to a certain depth, and then falling back onto the pump 36 and the cavity 34. This liquid fallback can carry gas into the intake of the pump 36, which is detrimental to the performance of the pump 36.

Figure 1A:
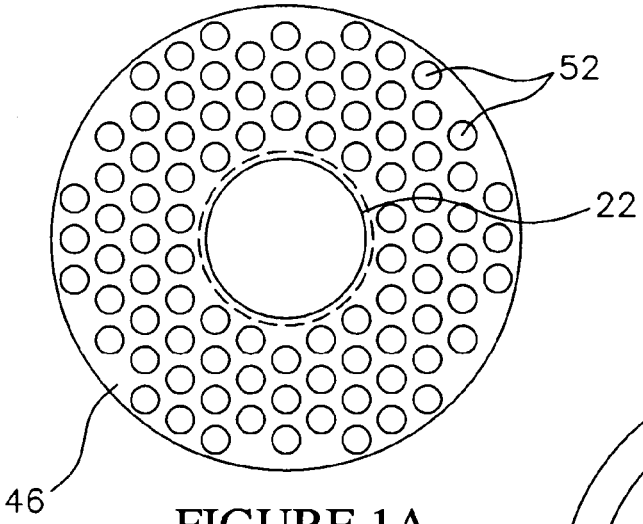
FIG. 1A is a cross sectional view with parts removed taken along section line 1A—1A of FIG. 1 illustrating a first baffle plate of the system.

As shown in FIG. 1A, the first baffle plate 46 has a generally circular peripheral configuration, which matches the circular cross sectional shape of the inside diameter of the well casing 14. In addition, the outside diameter of the first baffle plate 46 is only slightly less than the inside diameter of the well casing 14, such that the first baffle plate 46 fits snuggly within the well casing 14. The second baffle plate 48 and the third baffle plate 50 have a same size and outside peripheral shape as the first baffle plate 46. As shown in FIG. 1, the gas flow 26 and the liquid flow 28 in the annulus 24 must thus pass through the set of baffle plates 42, as there is little or no space between the outside diameter of the baffle plates 46, 48, 50 and the inside diameter of the well casing 14.

Figure 1B:
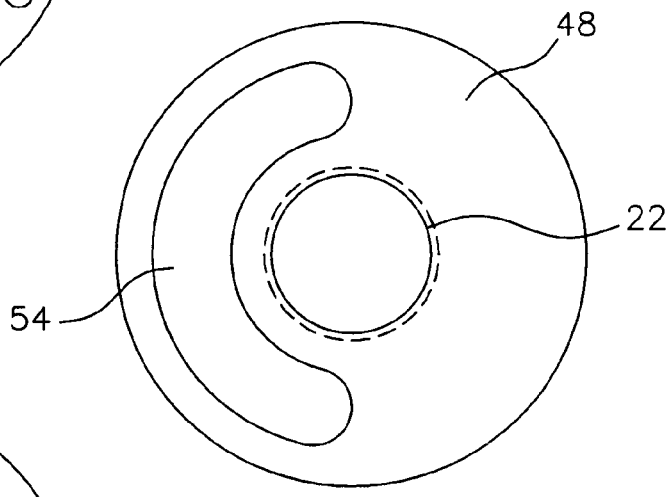
FIG. 1B is a cross sectional view with parts removed taken along section line 1B—1B of FIG. 1 illustrating a second baffle plate of the system.
Figure 1C:
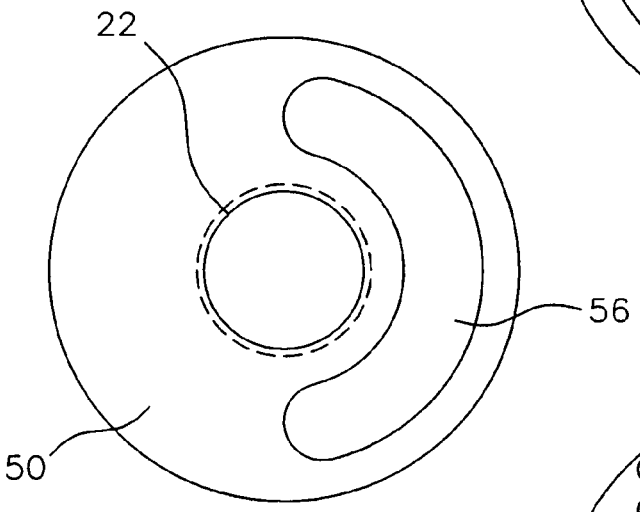
FIG. 1C is a cross sectional view with parts removed taken along section line 1C—1C of FIG. 1 illustrating a third baffle plate of the system.

As shown in FIG. 1A, the first baffle plate 46 includes a plurality of through openings 52, which comprise circles with a selected size and in a selected pattern. The first baffle plate 46 provides a solid surface area for collecting and condensing the liquid, while the openings 52 allow the gas flow 26 and the liquid flow 28 through the annulus 24. As shown in FIG. 1B, the second baffle plate 48 includes a single opening 54, which comprises an arcuate slot having a selected width and arcuate length. As shown in FIG. 1C, the third baffle plate 50 also includes a single opening 56, which comprises an arcuate slot having a selected width and arcuate length. In addition, the second baffle plate 48 and the third baffle plate 50 are oriented in the annulus 24, such that the openings 54, 56 have opposing orientations which are 180° apart.

Figure 1D:
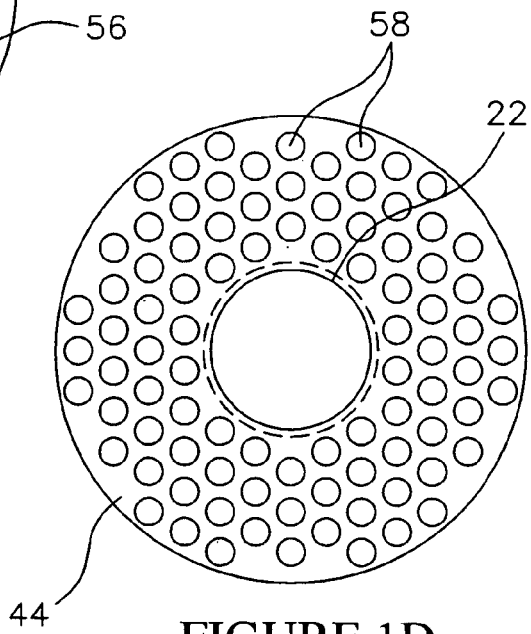
FIG. 1D is a cross sectional view with parts removed taken along section line 1D—1D of FIG. 1 illustrating a fourth baffle plate of the system.

The system 10 also includes a single baffle plate 44 located at a selected depth in the well 12 proximate to the surface 20. The single baffle plate 44 is configured to act as a final dehydration mechanism to remove as much liquid as possible from the gas flow 26 before it enters the gas production equipment 30. As shown in FIG. 1D, the single baffle plate 44 is substantially similar in construction to the first baffle plate 46, and includes a plurality of circular through openings 58 with a selected size and in a selected pattern. The single baffle plate 44 can be located a selected distance D2 from the surface 20 with from thirty to sixty feet being representative.

The baffle plates 46, 48, 50 for the set of baffle plates 42, and the single baffle plate 44, can be made of a machineable material able to resist the corrosive gases and fluids encountered in the subterranean well 12. One suitable material comprises a plastic, such as "LEXAN" polycarbonate manufactured by the General Electric Company, Polymer Product Department, Pittsfield, Miss. Other suitable materials include stainless steel, steel and brass.

Figure 1E:
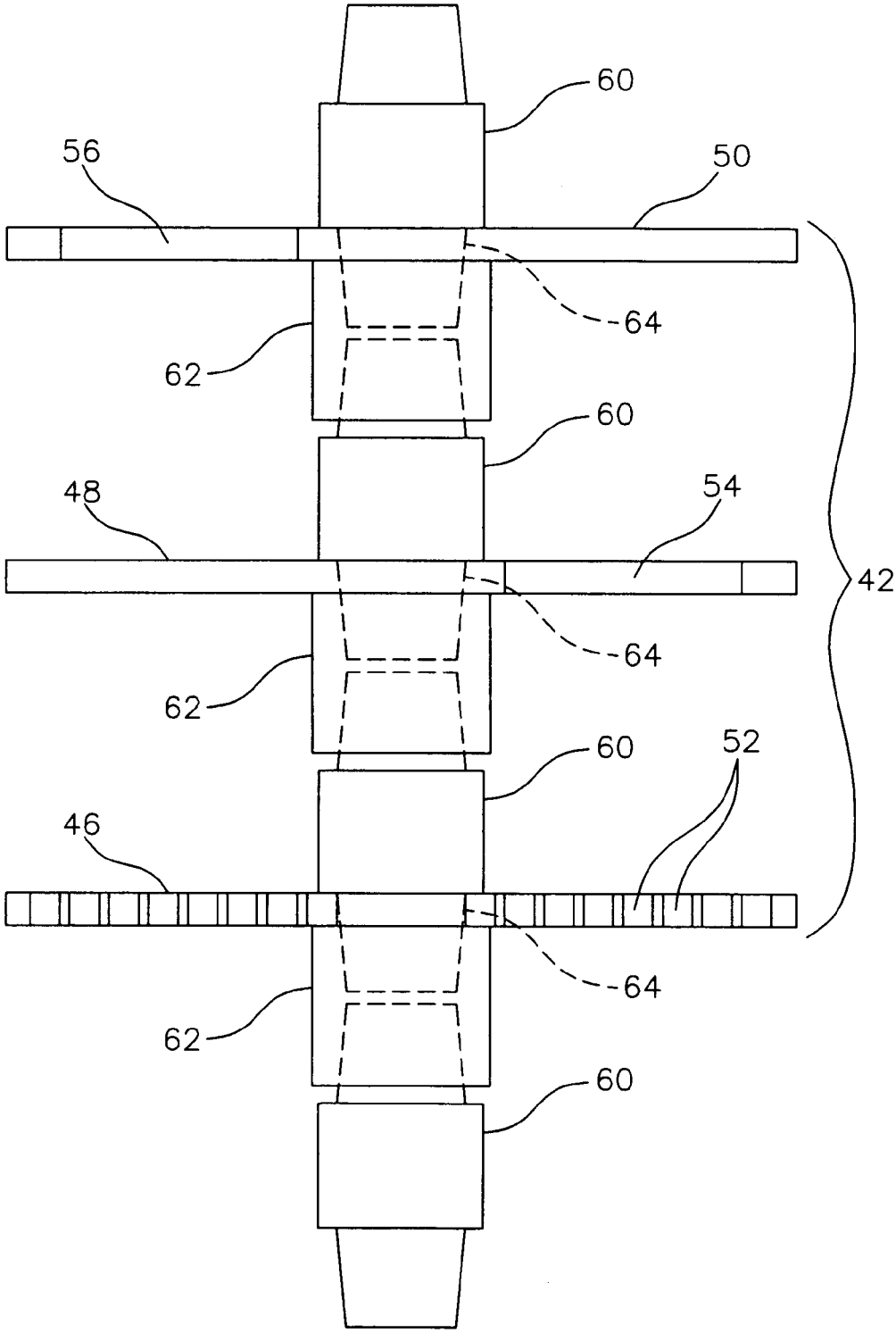
FIG. 1E is an enlarged view with parts removed taken along line 1E of FIG. 1 illustrating a set of baffle plates of the system.

The set of baffle plates 42, and the single baffle plate 44 can be attached to the tubular 22 in any suitable manner. One suitable configuration for the set of baffle plates 42 is illustrated in FIG. 1E. In the illustrative embodiment, threaded male pipe nipples 60 are configured to attach the set of baffle plates 42 to the tubular 22 at each end. Alternately, the set of baffle plates 42 can be attached to the tubular 22 at an upper end, and directly to the outlet of the pump 36 at a lower end.

As shown in FIG. 1E, the nipples 60 mate with threaded female pipe couplings 62. In addition, the baffle plates 46, 48, 50 have threaded openings 64 that threadably engage mating outside threads cut in the nipples 60, proximate to shoulder portions thereof. In the illustrative embodiment, the baffle plates 46, 48, 50 have a thickness of about 0.5 inches, and the nipples 60 have an extra thread of about this same thickness. Each baffle plate 46, 48, 50 is threadably attached to a nipple 60, which is then threadably attached to a coupling 62. Each baffle plate 46, 48, 50 is thus sandwiched between a nipple 60 and a coupling 62. In addition, the second baffle plate 48 is separated from the first baffle plate 46, and from the third baffle plate 50, by a nipple 60 and a coupling 62. In the illustrative embodiment, this separation distance is about one foot between adjacent baffle plates 46, 48, 50.

The uppermost nipple 60 threadably engages a corresponding coupling or female threads on the tubular 22. Similarly, the lowermost nipple 60 threadably engages a corresponding coupling or female threads on the tubular 22 on the pump 36. The inside diameter of the tubular 22 is thus in flow communication with the inside diameter of the nipples 60 and the couplings 62.

However, it is to be understood that this arrangement is merely exemplary and other mechanisms, such as brackets or weldments, can be used to attach the set of baffle plates 42 to the tubular 22. The single baffle plate 44 can be similarly mounted to a nipple 60 and a coupling 62, and attached to the tubular 22.

Figure 2A:
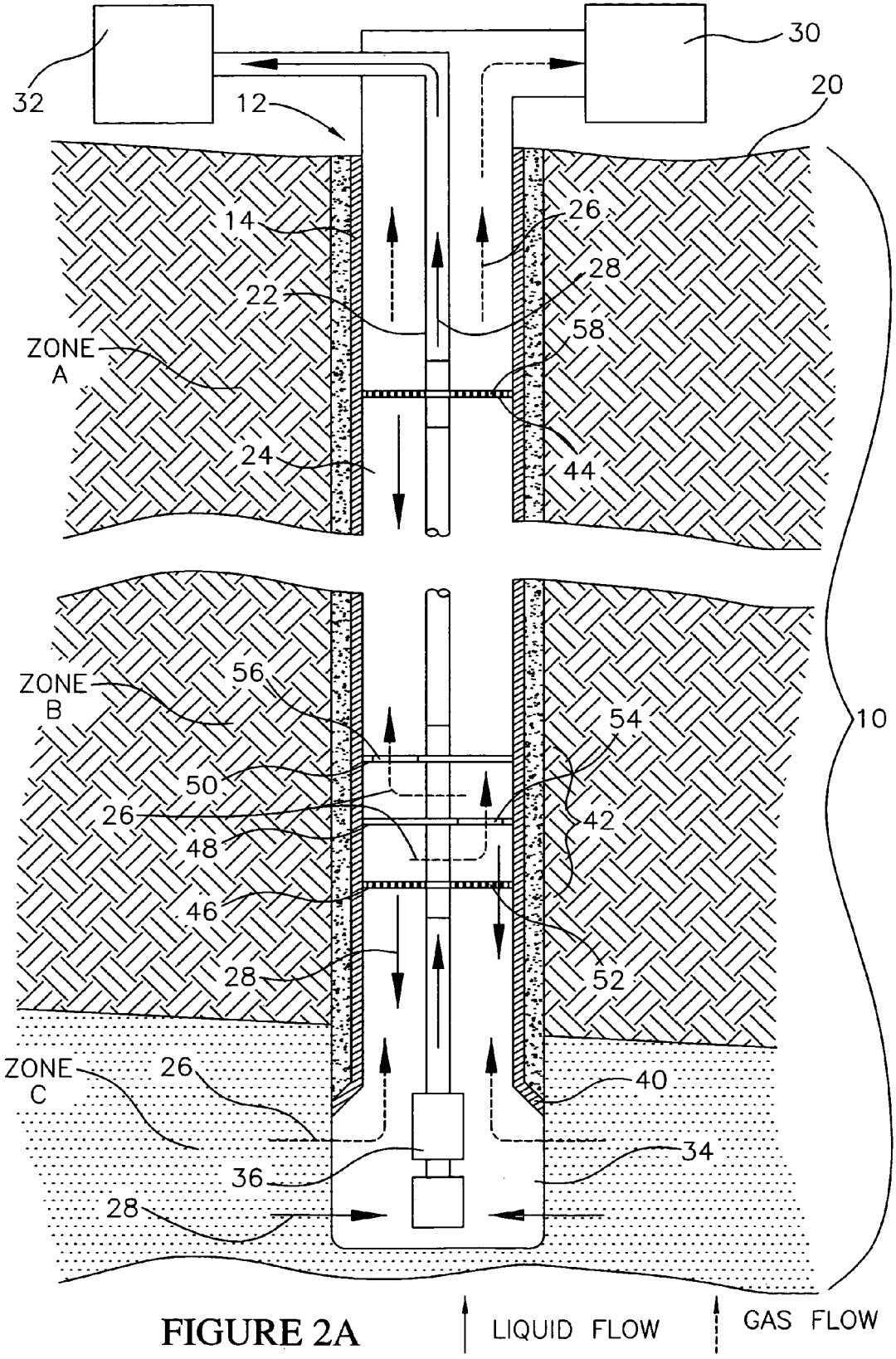
FIG. 2A is a schematic cross sectional view illustrating the well with the system of FIG. 1.

Referring to FIG. 2A, the operation of the well 12 and the system 10 (FIG. 1) are illustrated schematically. As shown in FIG. 2A, the liquid flow 28 initiates in the producing formation (Zone C), such that liquid accumulates in the cavity 34, and flows into the inlet of the pump 36. As indicated by the upward liquid flow 28 through the tubular 22, the pump 36 pumps the liquid through the tubular 22 to the liquid production equipment 32 at the surface 20. The gas flow 26 also initiates in the producing formation (Zone C), such that the gas accumulates in the cavity 34, and is directed through the casing shoe 40 into the annulus 24. The baffle plates 46, 48, 50 create a tortuous path for the gas flow 26, and at least some of the liquid entrained in the gas is condensed, and drops from the baffle plates 46, 48, 50 back into the cavity 34, as indicated by the downward liquid flow 28 from the baffle plates 46, 48, 50. This condensed liquid accumulates in the cavity 34, and is pumped by the pump 36 through the tubular 22 to the liquid production equipment 32 at the surface 20. In addition, the formation of heads of liquid in the annulus 24 is substantially eliminated, such that back pressure on the natural gas pressure in producing formation (Zone C) is reduced. This improves the flow of gas from the producing formation (Zone C) into the annulus 24.

As shown in FIG. 2A, the gas flow 26 continues through the annulus 24 to the single baffle plate 44, which acts as a final dehydration mechanism for separating at least some of the liquid entrained in the gas flow 26. As indicated by the upward gas flow 26 from the single baffle plate 44, a single phase gas flows through the annulus 24 to the gas production equipment 30 at the surface 20. As indicated by the downward liquid flow 28 from the single baffle plate 44, the removed liquid flows through the annulus 24 towards the cavity 34.

System 10A with Single Baffle Plate 44

Figure 3A:
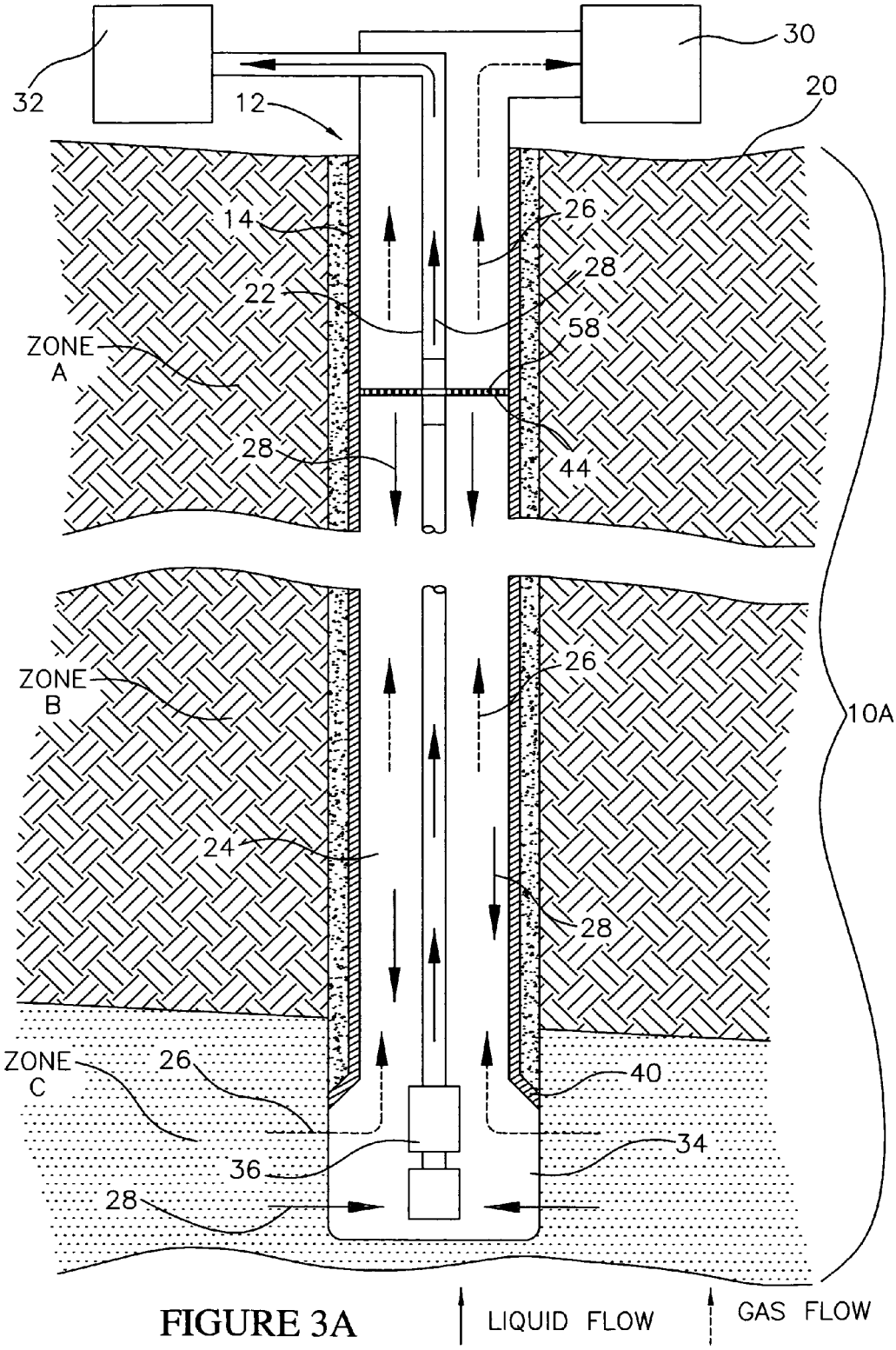
FIG. 3A is a schematic cross sectional view illustrating a gas well with a second embodiment system having a single baffle plate.

Referring to FIG. 3A, the well 12 and a second embodiment system 10A are illustrated schematically. With the system 10A, the single baffle plate 44 is installed approximately thirty to sixty feet from the surface 20 of the well 12. However, the system 10A does not include the set of baffle plates 42 (FIG. 1) proximate to the pump 36. The single baffle plate 44 operates substantially as previously described in the system 10 (FIG. 1). Specifically, gas flow 26 through the annulus 24 passes through the single baffle plate 44 which acts as a dehydration mechanism for removing at least some liquid from the gas. In addition, the single baffle plate 44 directs at least some liquid flow 28 back down the annulus 24 to the cavity 34.

System 10B with Set of Baffle Plate 42

Figure 4A:
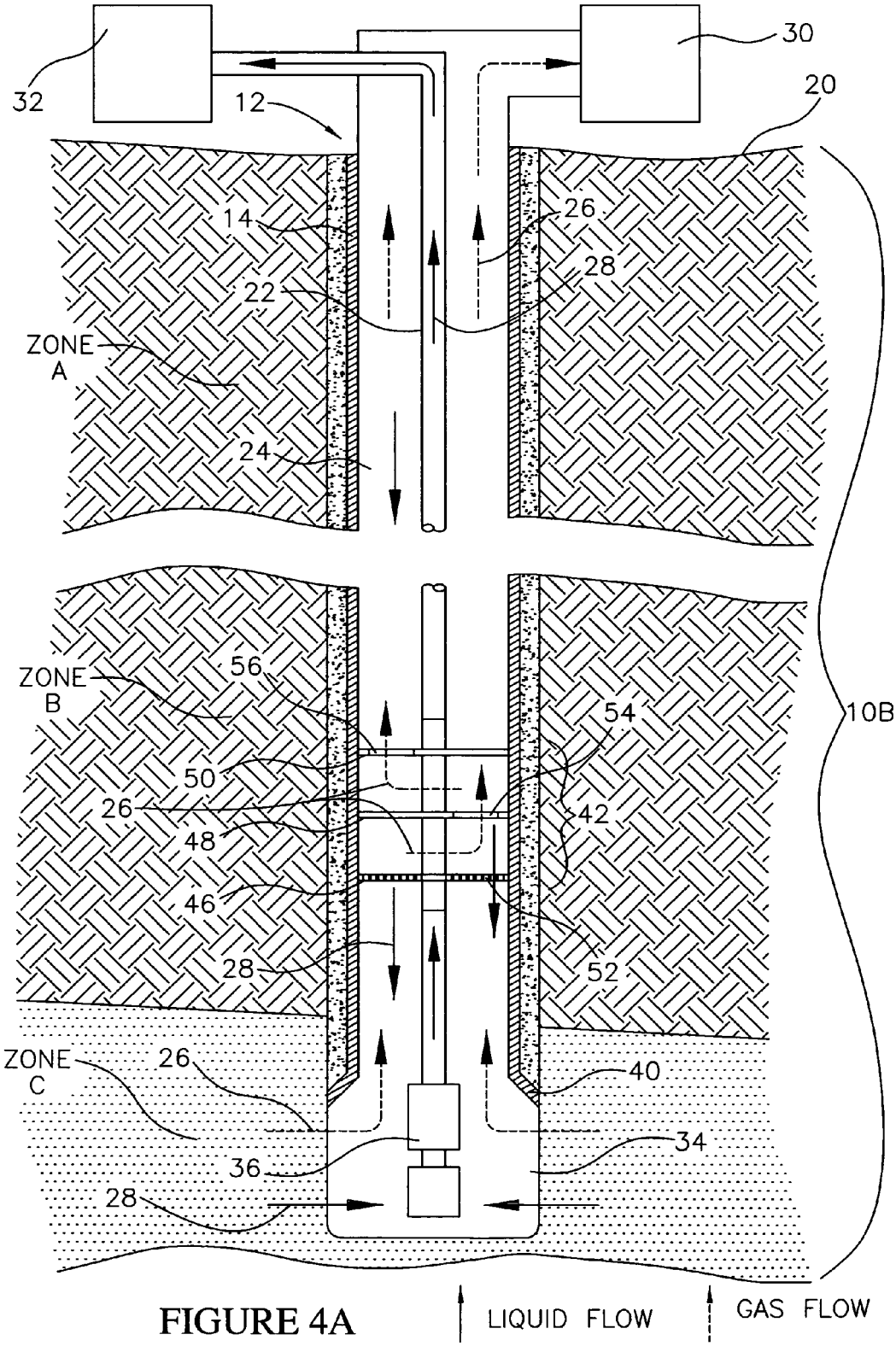
FIG. 4A is a schematic cross sectional view illustrating a gas well having a third embodiment system with a set of baffle plate.

Referring to FIG. 4A, the well 12 and a third embodiment system 10B are illustrated schematically. In the system 10B, the set of baffle plates 42 is located approximately one foot to thirty feet above the casing shoe 40, the pump 36 and the cavity 34. However, in the system 10B there is no single baffle plate 44 proximate to the surface 20. The set of baffle plates 42 operates substantially as previously described in the system 10 (FIG. 1). Specifically, the set of baffle plate 42 creates a tortuous path for the gas flow 26 and the liquid flow 28 in the annulus 24, separates at least some of the liquid from the gas, and directs some liquid flow 28 back down the annulus 24 to the cavity 34.

System 10C with Siphon String

Figure 5:
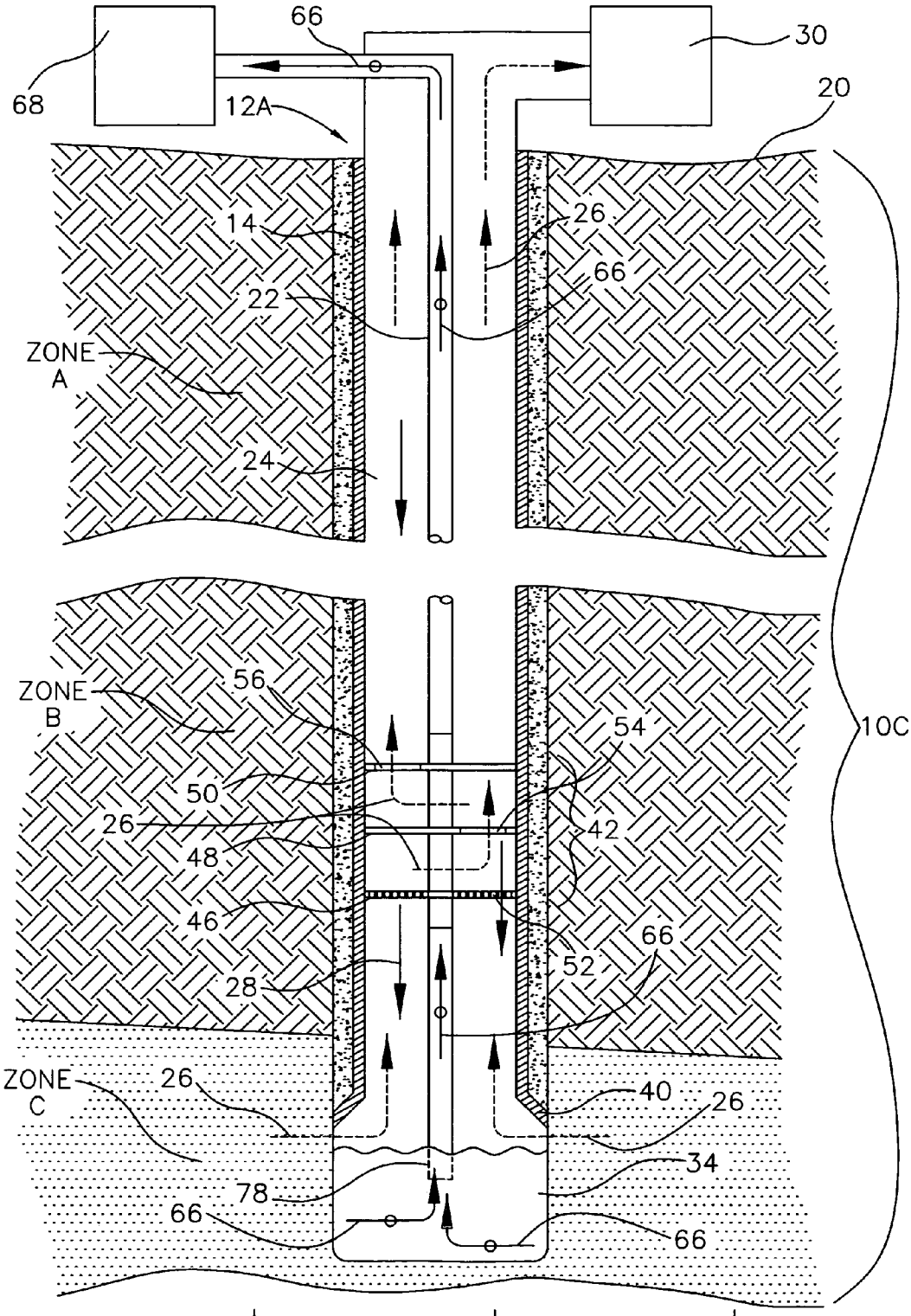
FIG. 5 is a schematic cross sectional view illustrating a siphon string gas well having a fourth embodiment system.

Referring to FIG. 5, a well 12A, and a fourth embodiment system 10C are illustrated schematically. The well 12A is constructed substantially as previously described for the well 12 (FIG. 1). However, the well 12A does not include an artificial lift such as the pump 36 (FIG. 1), but depends on gas and fluid pressures in the producing formation (Zone C) to move the gas and the liquid to the surface 20.

As indicated by gas flow 26 upward through the annulus 24, the well 12A produces gas through the annulus 24 to gas production equipment 30 at the surface 20. As indicated by gas and liquid flow 66 upward through the tubular 22, the well 12A produces liquid and gas through the tubular 22 to gas and liquid production equipment 68 at the surface 20. The tubular 22 includes an inlet 78 located within or proximate to the cavity 34 and the producing formation (Zone C), which directs the gas and liquid flow 66 from the cavity 34 upward through the tubular 22 to the gas and liquid production equipment 68. The gas and liquid flow 66 is generated by natural (or artificially generated) pressure in the producing formation (Zone C).

This type of well 12A is known in the art as a siphon string well, as the tubular 22 is used to siphon the liquid from the bottom of the well 12A using a portion of the gas flow for lift. In a conventional siphon string well, the momentum of the gas and liquid flow 66 rising vertically from below the tubular inlet 78 can cause a foam or liquid laden gas column to form just above the tubular inlet 78. This higher density column causes additional backpressure on the producing formation (Zone C), reducing the productivity of the well. The higher density column can also cause slugging of the gas and liquid flow 66 entering the tubular inlet 78, as it can no longer be supported by the gas velocity from below.

The system 10C includes the set of baffle plates 42 located about ten feet to thirty feet from the casing shoe 40 and the tubular inlet 78 of the well 12A. The set of baffle plates 42 creates a tortuous path for the gas flow 26 upward from the cavity 34 through the annulus 24. As indicated by the downward liquid flow 28 from the set of baffle plates 42, at least some of the liquid is separated from the gas. In addition, the set of baffle plates 42 functions to separate the gas and liquid phase below the tubular inlet 78 from a stable gas phase above the set of baffle plates 42. This substantially eliminates the additional backpressure and slugging described above.

System 10D with Dead String and Perforated Tubular

Figure 6:
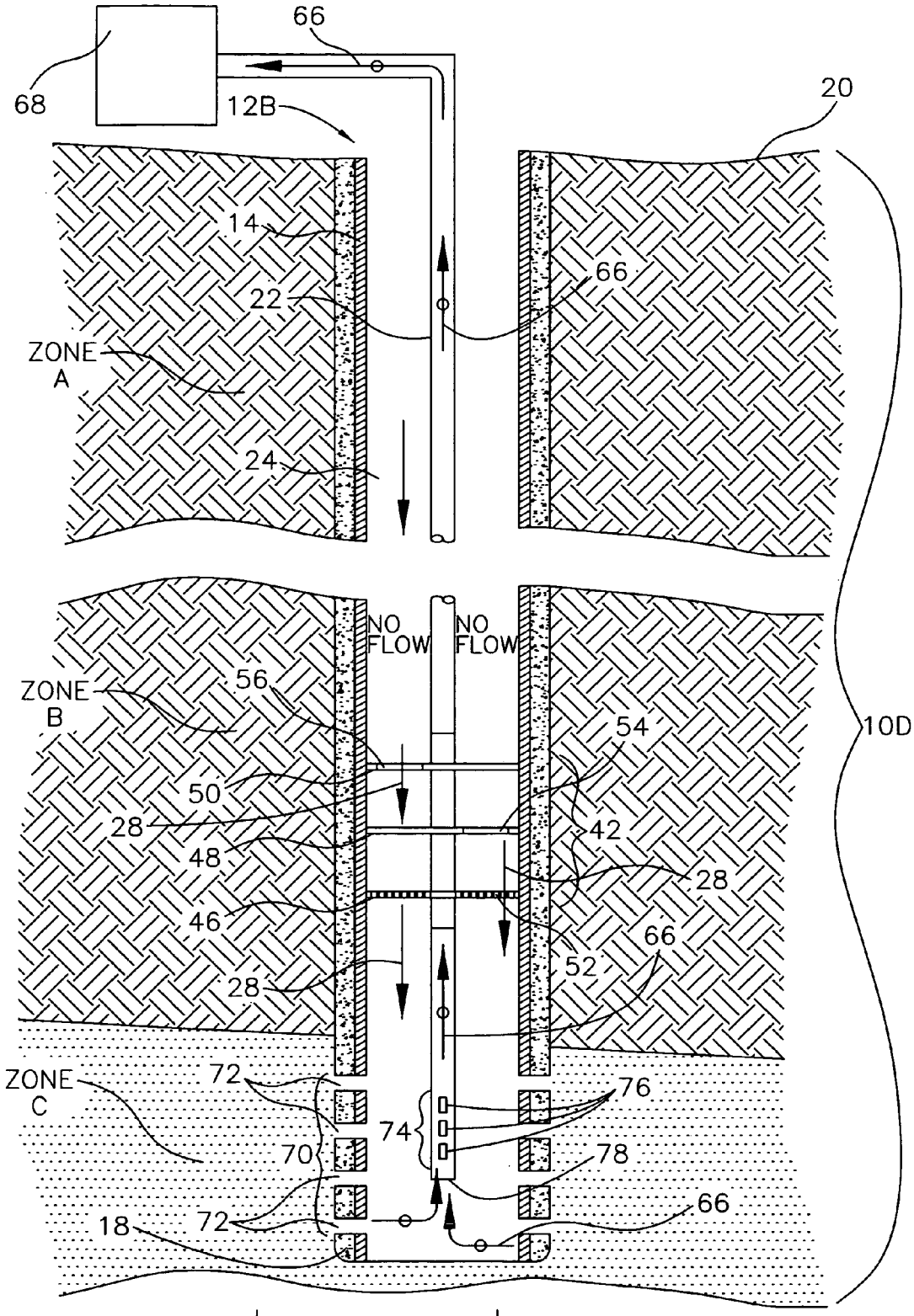
FIG. 6 is a schematic cross sectional view illustrating a dead string gas well having a fifth embodiment system.

Referring to FIG. 6, a well 12B, and a fifth embodiment system 10D are illustrated schematically. As with the well 12A (FIG. 5), there is no artificial lift and the gas and liquid flow 66 is generated by pressure in the producing formation (Zone C). As indicated by the gas and liquid flow 66 upward through the tubular 22, the well 12B produces liquid and gas through the tubular 22 to gas and liquid production equipment 68 at the surface 20. However, there is no gas flow 26 (FIG. 5) through the annulus 24 to the surface 20. This type of well is known in the art as a dead string well.

The well 12B also includes a perforated section 70 having a plurality of perforations 72 through the casing 14 and the concrete 18 in flow communication with the producing formation (Zone C). The tubular 22 includes an inlet 78 within or proximate to the perforated section 70 of the casing 14, and a perforated section 74 proximate to the inlet 78 having a plurality of perforations 76 there through. The tubular 22 is thus also in flow communication with the producing formation (Zone C).

The system 10D includes the set of baffle plates 42 located about ten feet to thirty feet from the perforated section 70 of the well 12B. As indicated by the downward liquid flow 28, the set of baffle plates 42 prevents the formation of large liquid columns in the annulus 24. As with the system 10C (FIG. 5), this substantially eliminates additional backpressure and slugging of the gas and liquid flow 66 at the perforations 76 and the inlet 78 of the tubular 22.

System 10E with Conventional Flow

Figure 7:
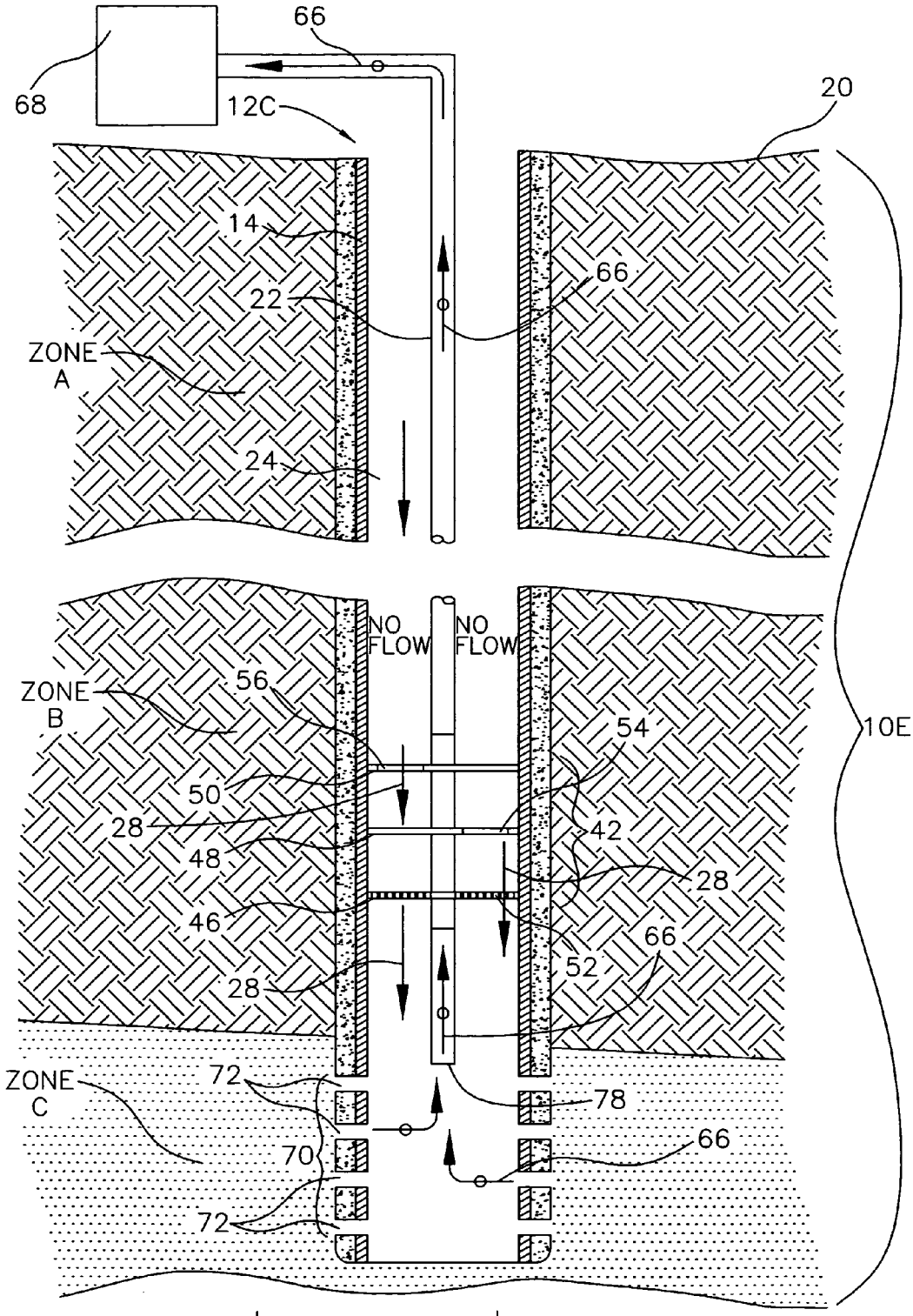
FIG. 7 is a schematic cross sectional view illustrating a conventional flowing gas well having a sixth embodiment system.

Referring to FIG. 7, a well 12C, and a sixth embodiment system 10E are illustrated schematically. As with the well 12B (FIG. 6), the well 12C produces liquid and gas through the tubular 22 to gas and liquid production equipment 68 at the surface 20. In addition, there is no gas flow 26 (FIG. 5) through the annulus 24 to the surface 20. The well 12C includes a perforated section 70 having a plurality of perforations 72 through the casing 14 and the concrete 18 in flow communication with the producing formation (Zone C). The tubular 22 includes an inlet 78 located above the perforated section 70.

The system 10E includes the set of baffle plates 42 located about ten feet to thirty feet from the inlet 78 of the tubular 22. As indicated by the downward liquid flow 28, the set of baffle plates 42 prevents the formation of large liquid columns in the annulus 24. As with the system 10C (FIG. 5), this substantially eliminates additional backpressure and slugging of the gas and liquid flow 66 at the inlet 78 of the tubular 22.

EXAMPLE 1

Figure 2B:
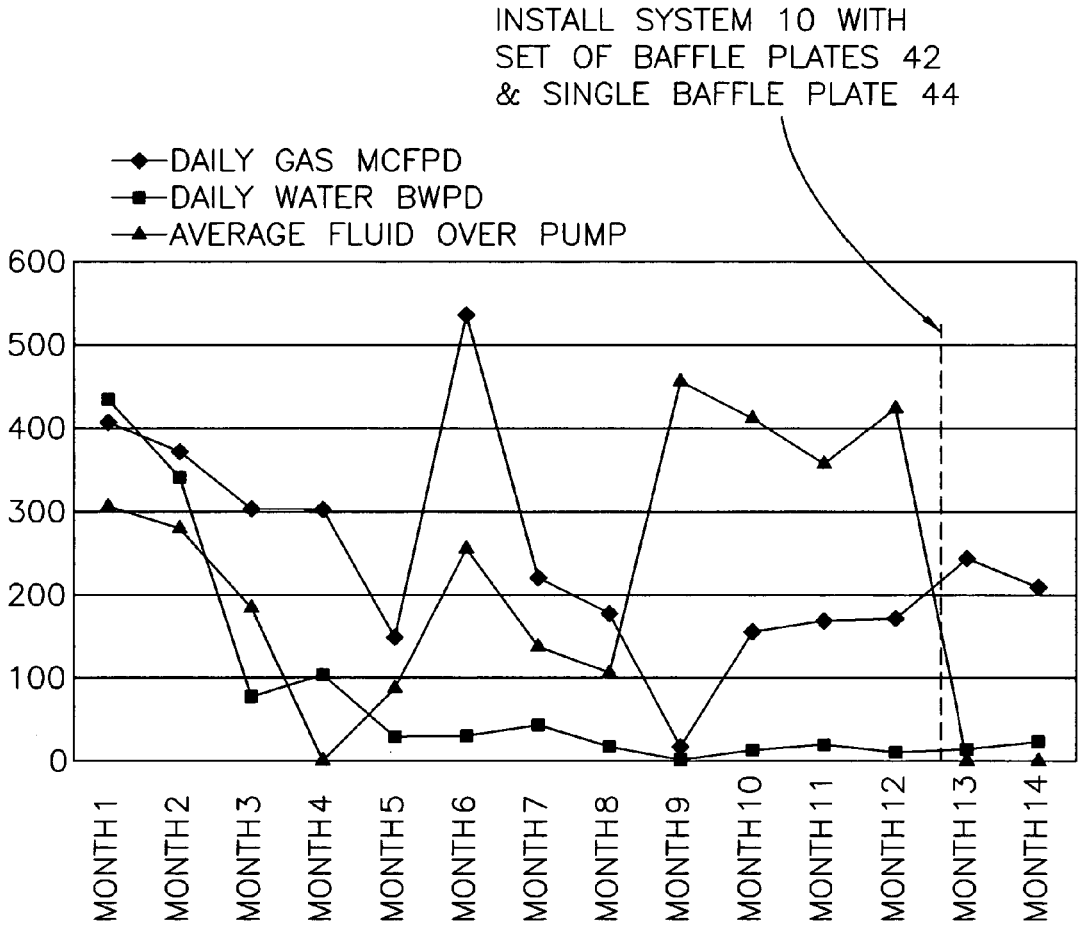
FIG. 2B is a graph illustrating operational parameters of the well with the system of FIG. 1.

FIG. 2B is a graph illustrating operational parameters of a methane gas well with the system 10 (FIG. 2A) located in the Powder River Basin of Wyoming. In the system 10 (FIG.

2A), the set of baffle plates 42 was installed approximately fifteen feet above the casing shoe 40, the pump 36 and the cavity 34. The single baffle plate 44 was installed approximately thirty to sixty feet from the surface 20.

In FIG. 2B "Daily Gas MCFPD" is represented by the line with diamond points, "Daily Water BWPD" is represented by the line with square points, and "Average Fluid Over Pump" is represented by the line with triangular points. Also in FIG. 2B, the horizontal axis quantifies time in one month increments, and the vertical axis quantifies the parameter.

As indicated by FIG. 2B, system 10 with the set of baffle plates 42 and the single baffle plate 44 was installed between "Month 12" and "Month 13". Following installation of the system 10, "Daily Gas MCFPD" increased relative to the preceding five months, the "Average Fluid Over Pump" decreased to zero, and "Daily Water BWPD" remained about the same.

EXAMPLE 2

Figure 3B:
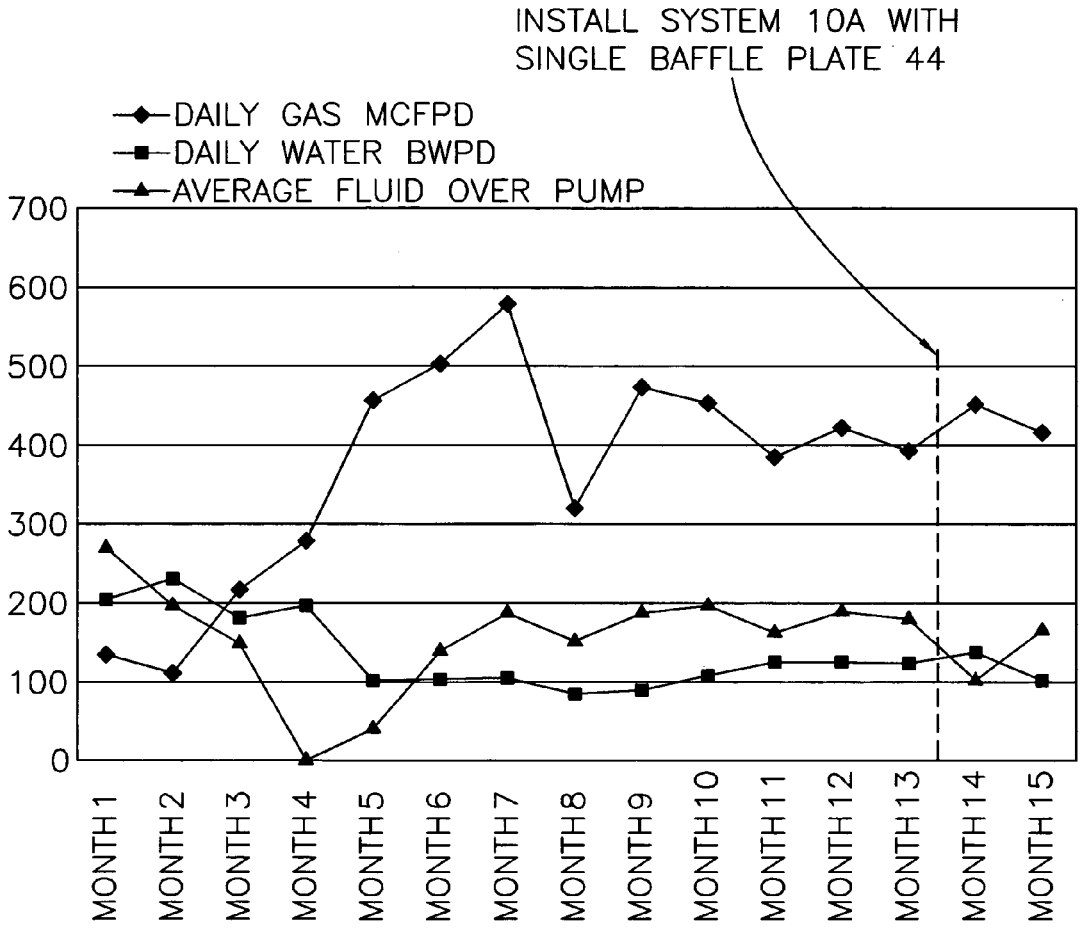
FIG. 3B is a graph illustrating operational parameters of the well with the system of FIG. 3A.
Figure 3C:
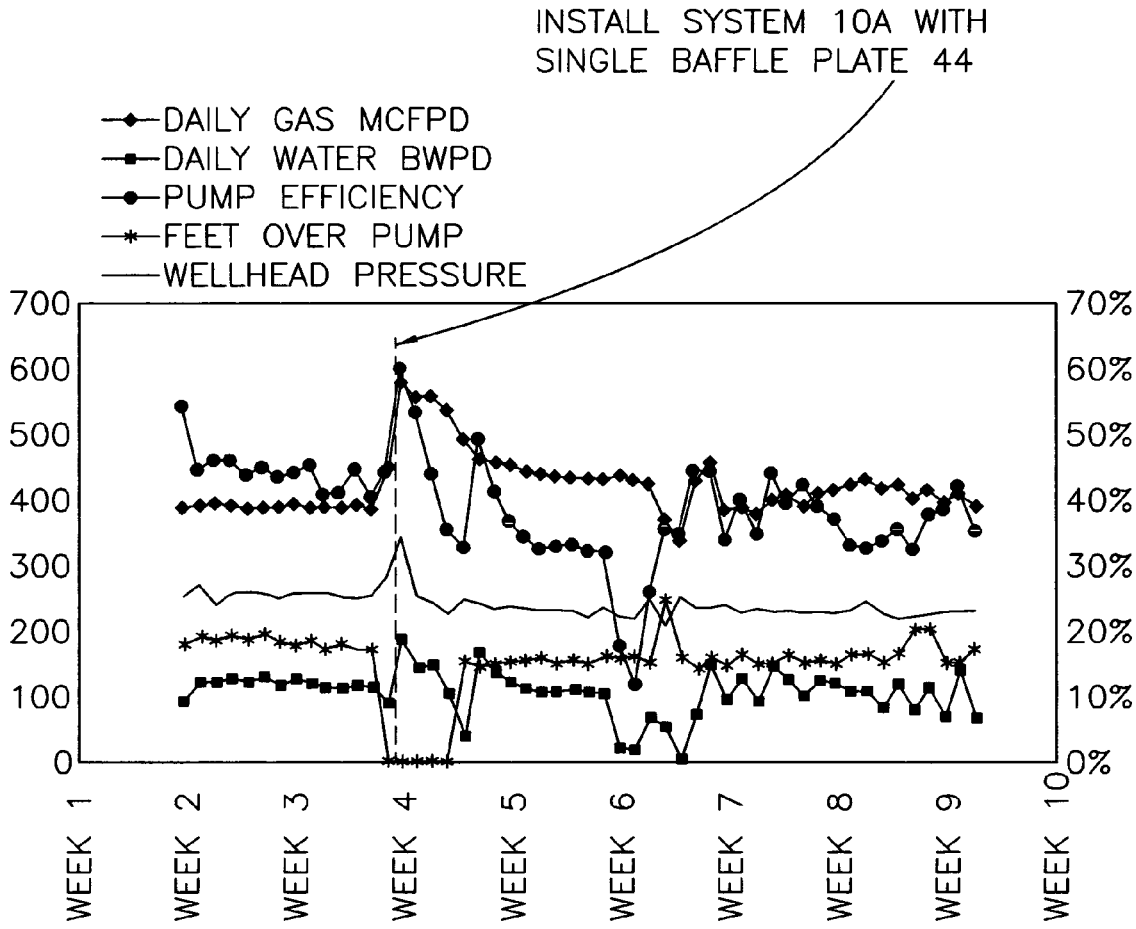
FIG. 3C is a graph illustrating operational characteristics of the well with the system of FIG. 3A.

FIG. 3B and FIG. 3C are graphs illustrating operational parameters of a methane gas well with the system 10A (FIG. 3A) located in the Powder River Basin of Wyoming. In the system 10A (FIG. 3A), the single baffle plate 44 was installed approximately sixty feet from the surface 20.

In FIG. 3B "Daily Gas MCFPD" is represented by the line with diamond points, "Daily Water BWPD" is represented by the line with square points, and "Average Fluid Over Pump" is represented by the line with triangular points. Also in FIG. 3B, the horizontal axis quantifies the time in one month increments, and the vertical axis quantifies the parameter.

As indicated by FIG. 3B, the system 10A (FIG. 3A) with the single baffle plate 44 was installed in the well between "Month 13" and "Month 14". Following installation of the system 10A (FIG. 3A), "Daily Gas MCFPD" increased relative to the preceding three months, "Average Fluid Over Pump" decreased relative to the preceding eight months, and "Daily Water BWPD" remained about the same.

In FIG. 3C, "Daily Gas MCFPD" is represented by the line with the diamond points, "Daily Water BWPD" is represented by the line with the square points, "Pump Efficiency" is represented by the line with the circular points, "Feet Over Pump" is represented by the line with the star points, and "Wellhead Pressure" (PSIG ×10) is represented by the line with no points. Also in FIG. 3C, the horizontal axis quantifies time in one week increments, and the vertical axis quantifies the parameters, except for pump efficiency, which is quantified on the right vertical axis as a percentage.

As indicated by FIG. 3C, the system 10A (FIG. 3A) with the single baffle plate 44 was installed in the well just before "Week 4". Following installation of the system 10A "Daily Gas MCFPD" increased relative to the previous weeks then decreased, "Daily Water BWPD" increased relative to the previous weeks then decreased, "Pump Efficiency" increased relative to the previous weeks then decreased, "Feet Over Pump" decreased to zero then increased, and "Wellhead Pressure" increased relative to the previous weeks then decreased.

EXAMPLE 3

Figure 4B:
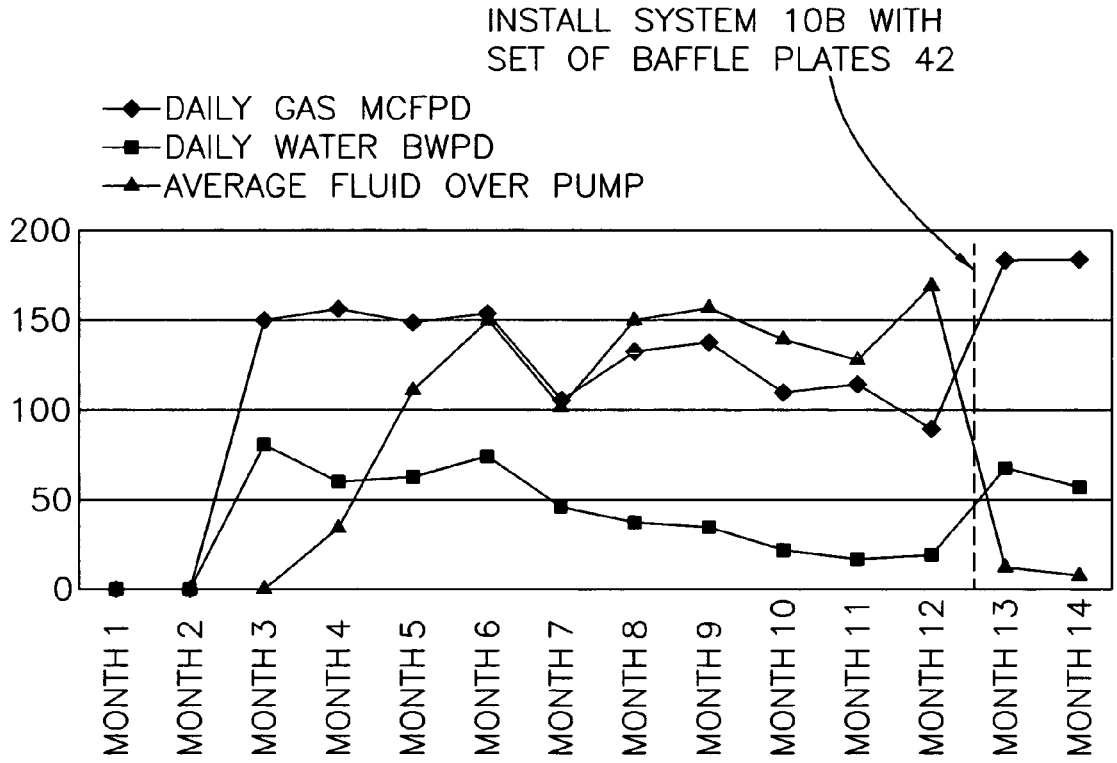
FIG. 4B is a graph illustrating operational parameters of the well with the system of FIG. 4A.
Figure 4C:
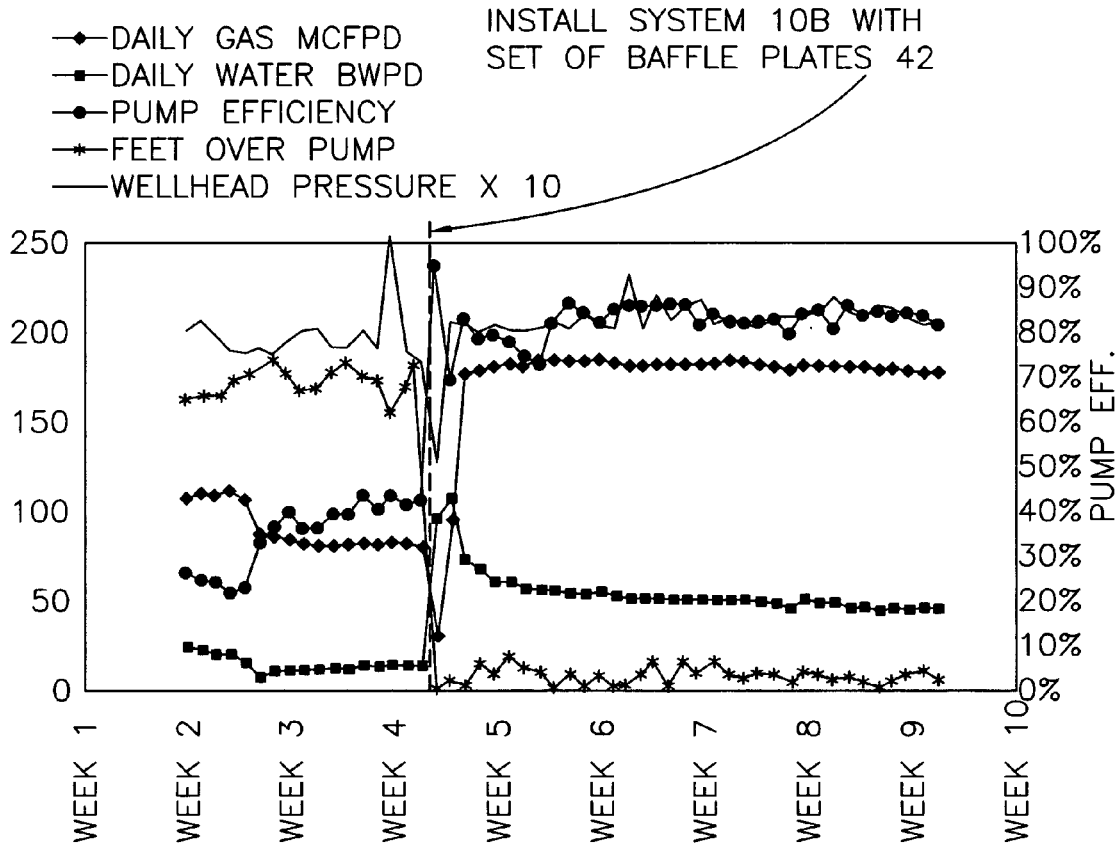
FIG. 4C is a graph illustrating operational parameters of the well with the system of FIG. 4A.

FIG. 4B and FIG. 4C are graphs illustrating operational parameters of a methane gas well with the system 10B (FIG. 4A) installed therein located in the Powder River Basin of Wyoming. In this example, the set of baffle plates 42 was installed approximately fifteen feet above the casing shoe 40, the pump 36 and the cavity 34.

In FIG. 4B "Daily Gas MCFPD" is represented by the line with diamond points, "Daily Water BWPD" is represented by the line with square points, and "Average Fluid Over Pump" is represented by the line with triangular points. Also in FIG. 4B, the horizontal axis quantifies time in one month increments, and the vertical axis quantifies the parameter.

As indicated by FIG. 4B, the system 10B with the set of baffle plates 42 was installed in the well between "Month 12" and "Month 13". Following installation of the system 10B, "Daily Gas MCFPD" increased relative to the preceding months, "Average Fluid Over Pump" decreased relative to the preceding months, and "Daily Water BWPD" increased relative to the preceding six months.

In FIG. 4C "Daily Gas MCFPD" is represented by the line with the diamond points, "Daily Water BWPD" is represented by the line with the square points, "Pump Efficiency" is represented by the line with the circular points, "Feet Over Pump" is represented by the line with the star points, and "Wellhead Pressure" (PSIG×10) is represented by the line with no points. Also in FIG. 4C, the horizontal axis quantifies the time in one week increments, the vertical axis on the left quantifies the above parameters except for pump efficiency which is listed on the right vertical axis as a percentage.

As indicated by FIG. 4C, the set of baffle plates 42 was installed in the well between "Week 4" and "Week 5". Following installation of the set of baffle plates 42 "Daily Gas MCFPD" increased relative to the previous weeks, "Daily Water BWPD" increased relative to the previous weeks, "Pump Efficiency" increased relative to the previous weeks, "Feet Over Pump" decreased over the previous weeks, and "Wellhead Pressure" decreased then increased relative to the previous weeks except for the spike at about "Week 4".

Thus the invention provides a method and a system for producing a gas and a liquid in a subterranean well. While the invention has been described with reference to certain preferred embodiments, as will be apparent to those skilled in the art, certain changes and modifications can be made without departing from the scope of the invention as defined by the following claims.

What is claimed is:

1. A method for producing a gas and a liquid in a well having an annulus formed between a casing and a tubular positioned within the casing, the method comprising:

directing the gas through at least one baffle plate in the annulus to separate at least some of the liquid from the gas.

2. The method of claim 1 further comprising directing the liquid separated during the directing step downward through the annulus.

3. The method of claim 1 wherein the well includes a pump for pumping the liquid, and further comprising directing the liquid separated during the directing step downward through the annulus to the pump.

4. The method of claim 1 wherein the well includes a cavity for accumulating the gas and the liquid, and the at least one baffle plate is located proximate to the cavity.

5. The method of claim 1 further comprising directing the gas through a second baffle plate positioned in the annulus and proximate to an earthen surface.

6. The method of claim 1 wherein said tubular is configured to produce the gas and the liquid to the surface by formation pressure and the at least one baffle plate is located proximate to an inlet of the tubular.

7. The method of claim 1 wherein said tubular has perforated section configured to produce the gas and the liquid to the surface by formation pressure and the at least one baffle plate is located proximate to the perforated section.

8. The method of claim 1 wherein said casing has a perforated section configured to produce the gas and the liquid to the surface by formation pressure and the at least one baffle plate is located proximate to the perforated section.

9. A method for producing a gas and a liquid in a well having a pump and an annulus formed between a casing and a tubular positioned within the casing, the method comprising:

directing the gas through a baffle plate in the annulus located proximate to the pump;

removing at least some of the liquid from the gas using the baffle plate; and directing the liquid from the removing step down the annulus to the pump.

10. The method of claim 9 further comprising prior to the directing the gas step placing the baffle plate proximate to the pump.

11. The method of claim 9 wherein the baffle plate is attached to said tubular in the annulus in flow communication with the pump and comprises a plate having at least one through opening through which said gas is directed.

12. The method of claim 9 further comprising directing the gas through a second baffle plate positioned in the annulus and proximate to an earthen surface.

13. The method of claim 9 wherein the gas comprises methane and the liquid comprises water.

14. The method of claim 9 wherein the well includes a cavity in a geological formation and the pump is located in the cavity.

15. A method for producing from a well having a cavity, a casing in flow communication with the cavity, a pump in the cavity, a tubular in the casing in flow communication with the pump, and an annulus between the tubular and the casing, the method comprising:

directing a gas from the cavity through the annulus and through a baffle plate in the annulus proximate to the pump; and separating a liquid from the gas during the directing step using the baffle plate.

16. The method of claim 15 further comprising providing a second baffle plate in the annulus proximate to a surface of the well, and separating at least some of the liquid from the gas using the second baffle plate.

17. The method of claim 15 further comprising directing a liquid flow from the baffle plate through the annulus to the cavity.

18. The method of claim 15 wherein the baffle plate comprises a circular plate having least one through opening and an outside diameter approximately equal to an inside diameter of the casing.

19. The method of claim 15 wherein the gas comprises methane and the liquid comprises water.

20. In a well having a casing, a tubular in the casing, and an annulus between the tubular and the casing, a method for producing from the well comprising:

directing a gas from a producing formation of the well into the annulus, through a first baffle plate in the annulus located proximate to the producing formation, and through a second baffle plate in the annulus located proximate to a surface of the well, the first baffle plate and the second baffle plate each having an outside diameter approximately equal to an inside diameter of the casing and at least one through opening;

condensing a liquid in the gas using the first baffle plate;

directing the liquid from the condensing step from the first baffle plate through the annulus towards the producing formation; and dehydrating the gas using the second baffle plate.

21. The method of claim 20 further comprising placing the first baffle plate in the annulus proximate to the producing formation and the second baffle plate in the annulus proximate to the surface prior to the directing the gas step.

22. The method of claim 20 wherein the well includes a pump in flow communication with the tubular configured to pump the liquid from the producing formation to the surface.

23. The method of claim 20 wherein the tubular is configured to produce the gas and the liquid to the surface by formation pressure and the first baffle plate is located proximate to an inlet of the tubular.

24. The method of claim 20 wherein the tubular includes a perforated section configured to produce the gas and the liquid to the surface by formation pressure and the baffle plate is located proximate to the perforated section.

25. The method of claim 20 wherein the casing includes a perforated section configured in flow communication with the producing formation by formation pressure and the at least one baffle plate is located proximate to the perforated section.

26. The method of claim 20 wherein the first baffle plate is part of a set of baffle plates.

27. The method of claim 26 wherein the set of baffle plates includes at least one baffle plate having an arcuate slot therein.

28. The method of claim 20 wherein the casing extends from the surface to a cavity in a coal seam.

29. The method of claim 20 wherein the tubular includes a male nipple attached to a female coupling with the first baffle plate therebetween.

30. A method for producing from a well having a producing formation, a casing in flow communication with the producing formation, a tubular in the casing in flow communication with the producing formation, and an annulus between the tubular and the casing, the method comprising:

directing a gas from the producing formation through the annulus and through a baffle plate in the annulus proximate; and separating a liquid from the gas during the directing step using the baffle plate.

31. The method of claim 30 wherein the baffle plate is located proximate to the producing formation.

32. The method of claim 30 further comprising providing a second baffle plate in the annulus proximate to a surface of the well, and separating at least some of the liquid from the gas using the second baffle plate.

33. The method of claim 30 wherein the baffle plate comprises a circular plate having least one through opening and an outside diameter approximately equal to an inside diameter of the casing.

34. The method of claim 30 wherein the gas comprises methane and the liquid comprises water.

35. A system for producing a gas and a liquid in a well comprising:

at least one baffle plate in the well configured to provide a tortuous path for the gas through the well and to separate at least some of the liquid from the gas.

36. The system of claim 35 wherein the well includes a casing, a tubular in the casing and an annulus between the casing and the tubular and the at least one baffle plate is located in the annulus.

37. The system of claim 35 further comprising a second baffle plate in the annulus proximate to a surface of the well.

38. The system of claim 35 wherein the at least one baffle plate is located proximate to a producing formation of the well.

39. The system of claim 35 wherein the well includes a downhole pump and the at least one baffle plate is located proximate to the pump.

40. The system of claim 35 wherein the well includes a perforating section of casing proximate to a producing formation and the baffle plate is located proximate to the perforating section.

41. The system of claim 35 wherein the well includes a tubular having an inlet in flow communication with a producing formation and the at least one baffle plate is located proximate to the inlet.

42. The system of claim 35 wherein the gas comprises methane and the liquid comprises water.

43. A system for producing a gas and a liquid in a well having a surface, a producing formation and an annulus comprising:

a first baffle plate in the annulus proximate to the producing formation configured to separate at least some of the liquid from the gas flowing in the annulus; and a second baffle plate in the annulus proximate to the surface configured to dehydrate the gas flowing in the annulus to the surface.

44. The system of claim 43 further comprising a tubular in flow communication with the producing formation configured to provide a flow conduit for the gas and the liquid to the surface.

45. The system of claim 43 further comprising a pump in flow communication with the producing formation and a tubular in flow communication with the pump configured to provide a flow conduit for the liquid to the surface.

46. The system of claim 43 further comprising a tubular in flow communication with the producing formation and wherein the first baffle plate and the second baffle plate are attached to the tubular.

47. The system of claim 43 wherein the well includes a cavity in a coal seam and a pump located in the cavity.

48. The system of claim 43 wherein the first baffle plate and the second baffle plate each comprise a plurality of circular openings.

49. The system of claim 43 wherein the first baffle plate is part of a set of baffle plates which includes a third baffle plate having a first slot, and a fourth baffle plate having a second slot oriented approximately 180° from the first slot.

50. The system of claim 43 wherein the first baffle plate comprises a polycarbonate.

51. The system of claim 43 wherein the second baffle plate comprises a polycarbonate.

52. A system for producing a gas and a liquid in a well having a surface, a casing, a pump, a tubular in the casing in flow communication with the pump, and an annulus between the tubular and the casing comprising:

a plurality of baffle plates attached to the tubular proximate to the pump configured to provide a tortuous path for the gas flowing up the annulus, and to separate at least some of the liquid from the gas; and at least one baffle plate attached to the tubular proximate to the surface configured to dehydrate at least some of the liquid from the gas.

53. The system of claim 52 wherein the plurality of baffle plates and the single baffle plate have an outside diameter approximately equal to an inside diameter of the casing.

54. The system of claim 52 wherein the plurality of baffle plates include a first baffle plate having a plurality of circular openings, a second baffle plate having a first arcuate slot, and a third baffle plate having a second arcuate slot.

55. The system of claim 52 wherein the at least one baffle plate includes a plurality of circular openings in a selected pattern.

56. The system of claim 52 wherein the tubular includes a plurality of male nipples attached to corresponding female couplings with the baffle plates clamped between the nipples and the couplings.

57. The system of claim 52 wherein the plurality of baffle plates is located about one to thirty feet from the pump.

58. The system of claim 52 wherein the single baffle plate is located about thirty to sixty feet from the surface.

59. In a well having a surface, a casing, a producing formation, a tubular in the casing having an inlet in flow communication with the producing formation, and an annulus between the tubular and the casing, a system for producing a gas and a liquid from the well comprising:

a set of baffle plates attached to the tubular proximate to the inlet configured to separate and direct at least some liquid from a gas flow in the annulus back down the annulus towards the producing formation; and a single baffle plate attached to the tubular proximate to the surface configured to dehydrate the gas flow in the annulus to the surface.

60. The system of claim 59 wherein the set of baffle plates includes a first baffle plate having a plurality of first circular openings therethrough, a second baffle plate having a first slot therethrough, and a third baffle plate having a second slot therethrough.

61. The system of claim 59 wherein the single baffle plate includes a plurality of second circular openings therethrough.

62. The system of claim 59 wherein each baffle plate of the set of baffle plate comprises a polycarbonate.

63. The system of claim 59 wherein the single baffle plate comprises a polycarbonate.

64. The system of claim 59 wherein the casing includes a perforated section in flow communication with the producing formation.

65. The system of claim 59 wherein the tubular includes a perforated section in flow communication with the producing formation.

66. The system of claim 59 wherein the well includes a pump in flow communication with the producing formation and the tubular.

* * * * *